United States Patent [19]

Shimoda

[11] Patent Number: 4,843,944

[45] Date of Patent: Jul. 4, 1989

[54] IDIOPHONE

[75] Inventor: Isao Shimoda, Hamamatsu, Japan

[73] Assignee: Yamaha Corporation, Japan

[21] Appl. No.: 255,725

[22] Filed: Oct. 11, 1988

[30] Foreign Application Priority Data

Oct. 23, 1987 [JP] Japan ..... 62-162177[U]
Oct. 23, 1987 [JP] Japan ..... 62-162178[U]

[51] Int. Cl.[4] ..... G10D 13/02
[52] U.S. Cl. ..... 84/418; 84/402
[58] Field of Search ..... 84/418, 402

[56] References Cited

U.S. PATENT DOCUMENTS 587,561 8/1897 Sherman ..... 84/418 X
3,566,737 3/1971 Gussak ..... 84/402
4,346,637 8/1982 Janszen ..... 84/418

*Primary Examiner*—Lawrence R. Franklin
*Attorney, Agent, or Firm*—Lerner, David, Littenberg, Krumholz & Mentlik

[57] ABSTRACT

In construction of an idiophone such as a tambourine having paired metallic jingles idly supported by carrier rods in respective windows formed transversely through an elongated shell, each carrier rod is fixed at both ends by inner ridges of the shell and the end of each shell project inwards beyond walls of the shell. Multiple phased collisions between the jingles, between the jingles and the ridges and between the jingles and the walls enable generation of colorful musical tones with rich acoustic variety and tone quality.

6 Claims, 3 Drawing Sheets

IDIOPHONE

BACKGROUND OF THE INVENTION

The present invention relates to an improved idiophone, and more particularly relates to improvement in tone quality of musical tones produced by an idiophone such as a tambourine.

A tambourine is a typical example of an idiophone. A tambourine in general includes an annular shell having several radially through windows circumferentially spaced from each other at an equal interval and several pairs of metallic jingles arranged in the windows. One or more resonator chambers may be optionally formed in the frame at sections between adjacent windows. More specifically, each window is spanned by a fixed carrier rod which extends substantially normal to the plane of circularity of the annular shell and a pair of metallic jingles are idly inserted over the carrier rod at their centers.

When the head of the tambourine is bashed or the tambourine is shaken by the player's hand, musical tones are generated by mutual collision of the metallic jingles and/or collision of the metallic jingles with the walls of each window fixing the carrier rod.

This tone generating mechanism is based on the three-point collision of the metallic jingles only and, as a consequence, rather poor in acoustic variety.

Further, such a poor acoustic variety is additionally caused by the fact that each pair of jingles are made of a same material. This in particular degrades richness in tone quality.

It is the basic object of the present invention to provide an idiophone generative of musical tones with rich acoustic variety.

It is another object of the present invention to provide an idiophone generative of musical tones of rich tonal quality.

SUMMARY OF THE INVENTION

In accordance with the basic aspect of the present invention, a cavitious elongated shell has at least one transverse window which is spanned by a carrier rod for idly supporting a pair of metallic jingles, the carrier rod is fixed at both ends by a pair of inner ridges on the shell, and the end of each ridge projects inward beyond associated walls of the window.

DESCRIPTION OF THE PREFERRED EMBODIMENT

Figure 1:
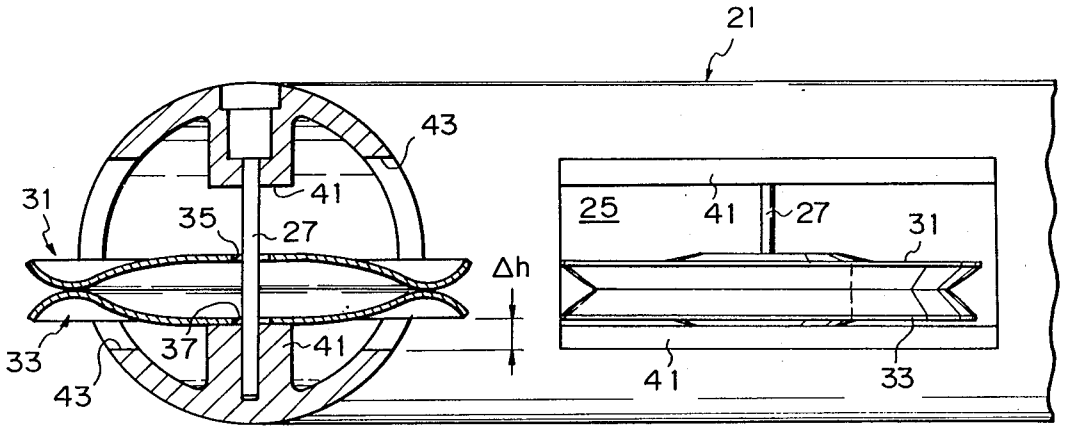
FIGS. 1 and 2 are side views, partly in section, of one embodiment of the idiophone in accordance with the present invention in different conditions.

One embodiment of the idiophone in accordance with the present invention is shown in Fig.1 in the form of a tambourine. The tambourine has an annular shell 21 provided with a plurality of radially through windows 25 circumferentially spaced from each other at an equal interval and each window 25 is spanned by a carrier rod 27 extending substantially normal to the plane of circularity of the annular shell 21. A pair of metallic jingles 31 and 33 are idly inserted over the carrier rod 27 at center apertures 35 and 37 somewhat larger in diameter than the carrier rod 27.

The annular shell 21 is tubular in the cross-sectional profile and provided with a pair of aligned inner ridges 41 which project substantially normal to the above-described plane of circularity in order to fix both ends of the carrier rod 27. The window 25 has a pair of walls 43 spaced apart in a direction normal to the plane of circularity. The end face of each ridge 41 projects inwards beyond the associated walls 43 by a gap $\Delta$ h which is properly chosen in reference to the diameter of the metallic jingles 31 and 33.

When the tambourine of the above-described construction is shaken, the metallic jingles 31 and 33 move on the carrier rod 27. One of the jingles first collides against the ridge 41 for initial tone generation and the other of the jingles collides against the one jingle for subsequent tone generation.

Figure 2:
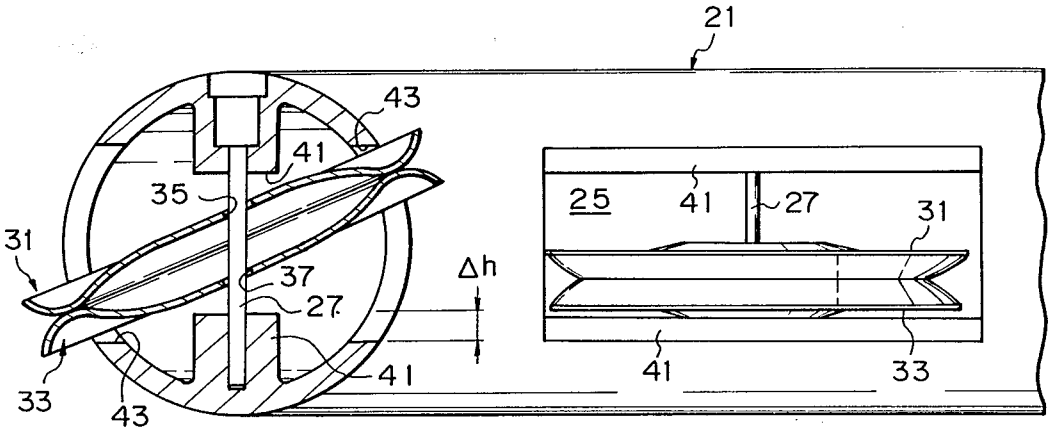

Thereupon, due to the double collision, the metallic jingles 31 and 33 assume inclined positions as shown in Fig.2 and collide against the walls 43 for tone generation. This collision causes secondary collision between the metallic jingles 31 and 33 for further tone generation. Thus, one movement of the metallic jingles 31 and 33 on the carrier rod 27 generally induces several occurrences of subsequent tone generations with subtle differences in mode, thereby greatly enriching acoustic variety.

At mutual collision between the metallic jingles 31 and 33, one of the jingles first collides against one of the ridges 41 and, thereafter, the other of the jingles collides against the one jingle. Thus, tone generations are repeated in six different modes. That is, the one jingle 31 collides against the one ridge 41, the other jingle 33 collides against the other ridge 41, the one jingle 31 in inclined positions collides against the one walls 43 and the other jingle 33 in inclined positions collides against the other walls 43.

In another embodiment of the idiophone in accordance with the present invention, the paired jingles are made of different materials. For example, one jingles 31 are made of bronze phosphate and other jingles 33 are made of brass. The combination may be reversed from pair to pair. Collision of jingles of different materials enables generation of musical tones with subtle difference in tone quality.

Figure 3:
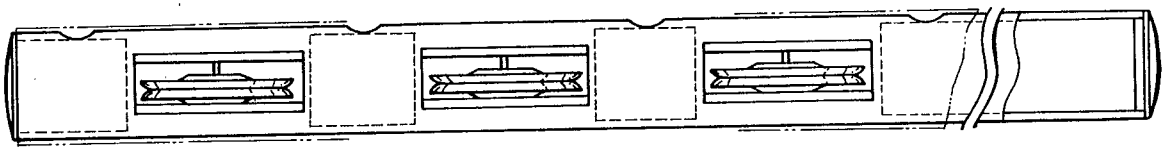
Figs.3 and 4 are side views, partly in section, of another embodiment of the idiophone in accordance with the present invention in different conditions.
Figure 4:
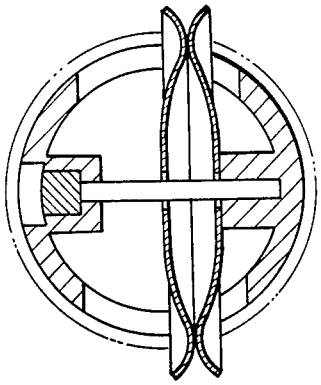

One example of a straight-type idiophone is shown in FIGS. 3 and 4.

Although a tambourine with an annular shell is exemplified in the foregoing descriptions, the present invention is well applicable to stick-type idiophones and idiophones with membranes too. Further, the walls of each window may be somewhat stepped.

I claim:

1. An improved idiophone comprising an elongated shell having at least one transverse window, a carrier rod spanning said at least one transverse window substantially normal to the longitudinal direction of said elongated shell, first and second opposed inner ridges projecting from said elongated shell within said at least one transverse window and fixing the ends of said carrier rod, each of said inner ridges having an inner end distal from said elongated shell, said at least one transverse window having a first pair of opposite walls outwardly of said first inner ridge and a second pair of opposite walls outwardly of said second inner ridge, said first and second pairs of opposite walls being spaced apart from each other in the axial direction of said carrier rod so that said inner ends of said first and second inner ridges project inwardly beyond said associated pair of walls, and a pair of metallic jingles idly inserted over said carrier rod, said pair of metallic jingles each having an outer periphery which extends outwardly beyond said first and second pairs of opposite walls, whereby tones are generated by collisions between said pair of metallic jingles, said first and second opposed inner ridges, and said first and second pair of opposite walls.

2. An improved idiophone as claimed in claim 1 wherein each of said jingles is made from a different metallic material.

3. An improved idiophone as claimed in claim 1 wherein each of said first and second pair of opposite walls is stepped.

4. An improved idiophone as claimed in claim 2 wherein each of said first and second pair of opposite walls is stepped.

5. An improved idiophone as claimed in claim 1, 2 or 3 where said shell is annular in configuration and tubular in cross-sectional profile, and said carrier rod extends substantially normal to the plane of circularity of said shell.

6. An improved idiophone as claimed in claim 1, 2 or 3 wherein said shell is substantially straight in construction.

* * * * *